United States Patent [19]

Takahashi et al.

[11] Patent Number: 5,064,696

[45] Date of Patent: Nov. 12, 1991

[54] PIGMENT CONTAINING FILM COATING METHOD UTILIZING A COLLIDING OF TWO FLOW STREAMS

[75] Inventors: Masashi Takahashi; Yuka Nakamura; Sadao Kajiura; Koichi Tsunemi, all of Kanagawa, Japan

[73] Assignee: Kabushiki Kaisha Toshiba, Kawasaki, Japan

[21] Appl. No.: 381,803

[22] Filed: Jul. 19, 1989

[30] Foreign Application Priority Data

Sep. 8, 1988 [JP] Japan ..... 63-223515

[51] Int. Cl.[5] ..... B05D 1/18

[52] U.S. Cl. ..... 427/430.1; 427/345; 241/5; 241/21; 118/429; 118/612; 118/608; 118/602

[58] Field of Search ..... 427/345, 430.1; 118/600, 602, 608, 612, 429; 241/5, 21

[56] References Cited

U.S. PATENT DOCUMENTS

| | | | |
|---|---|---|---|
| 2,045,006 | 6/1936 | Wiegand | 241/21 X |
| 3,511,693 | 5/1970 | Davidson | 427/345 |
| 3,925,580 | 12/1975 | Brewer | 427/345 X |
| 4,606,949 | 8/1986 | Yoshihara et al. | 427/430.1 |

FOREIGN PATENT DOCUMENTS

| | | |
|---|---|---|
| 60-29752 | 2/1985 | Japan . |
| 60-29753 | 2/1985 | Japan . |
| 60-68081 | 4/1985 | Japan . |
| 60-146238 | 8/1985 | Japan . |
| 60-146239 | 8/1985 | Japan . |
| 60-146240 | 8/1985 | Japan . |
| 60-146241 | 8/1985 | Japan . |
| 60-146242 | 8/1985 | Japan . |
| 60-208759 | 10/1985 | Japan . |

*Primary Examiner*—Shrive Beck
*Assistant Examiner*—Alain Bashore
*Attorney, Agent, or Firm*—Foley & Lardner

[57] ABSTRACT

A method for forming a pigment containing film on a work-piece includes the steps of circulating coating liquid containing pigment through a circulation path, and pulverizing the pigment to disperse the pigment in the coating liquid during the circulating step. The method further includes the steps of dipping a work-piece in the coating liquid during the circulating step, and raising the work-piece from the coating liquid. An apparatus for forming a pigment containing film on a work-piece includes a coating tank, having an inflow portion and an overflow portion, for holding coating liquid containing pigment, and a circulation path having one end connected to the inflow portion of the coating tank and the other end connected to the overflow portion of the coating tank, for circulating the coating liquid. In the circulation path, a pulverizing device is arranged for pulverizing the pigment to disperse the pigment in the coating liquid and to cause the coating liquid to flow in the circulation path. The apparatus further includes a work-piece mounting device for dipping a work-piece in the coating liquid held in the coating tank and raising the work-piece from the coating liquid to form a pigment containing film on the work-piece during the circulating of the coating liquid along the circulation path. A coated medium includes a work-piece, and a film coated on the work-piece by dipping the work-piece in circulated coating liquid in which pigment has been dispersed using an impact pulverizing disperser.

9 Claims, 2 Drawing Sheets

PIGMENT CONTAINING FILM COATING METHOD UTILIZING A COLLIDING OF TWO FLOW STREAMS

BACKGROUND OF THE INVENTION

1. Field of the Invention

The present invention relates to a method for forming a pigment containing film on a work-piece.

The present invention also relates to a circulatory coating apparatus used for applying a pigment containing coating in which the pigment is liable to coagulate.

Furthermore, the present invention relates to a pigment containing film obtained using this circulatory coating apparatus.

2. Description of the Related Art

In general, in precision application of coatings which are required to have a very precise film thickness, the dip coating method is often used. One method of dip coating that is often used, because it permits control of the concentration of the coating liquid, its viscosity and the level of the liquid surface, is the circulatory method, in which dipping of the work-piece that is to be coated into the coating liquid causes this liquid to overflow from the coating tank, the liquid then being recirculated. Rotary pumps and diaphragm pumps etc. are employed in this circulatory method as means for moving the coating liquid.

In recent years, in the field of paints and pigments, the object of coating has changed from simply improving the appearance and preventing rust, etc., to that of obtaining improved functionality. Examples that may be given of such improved functionality are recording coloring matters or display coloring matters used as electroluminescent materials or electrochromic materials, near infrared absorption coloring matter for optical discs, coloring materials for use in devices such as printers and copiers, such as coloring matter for color filters, organic photoconductive materials and pressuresensitive or heat-sensitive materials, and coloring materials for energy use, such as organic coloring matter for solar cells.

Such improved functionality is often attained, in particular in thin films from the submicron to 20 micron thickness range, by higher pigment loadings than in the case of ordinary coatings. It is therefore necessary to use a pigment-rich low viscosity dispersion. As a result, it is extremely difficult to maintain dispersibility of the pigment, due to problems such as sedimentation of the pigment and occurrence of flocculation of the pigment when subjected to slight shock.

In order to maintain dispersion of the pigment, addition of surfactants, as is done in the coating industry, has been considered. However, not only is considerable time required for selection of the surfactant, but also, the surfactant constitutes an impurity which has an adverse effect on improvement of functionality. Furthermore, the circulation of the coating liquid produces bubbles in the coating liquid, which result in formation of coating non-uniformities. Such coating non-uniformities cause variation of device characteristics.

Several methods which have been proposed for preventing such coating non-uniformity. They include: applying ultrasonic waves to the circulating coating liquid (Japanese Patent Disclosure (Kokai) No. 60-68081); applying a shearing force to the coating liquid immediately before coating, for example by stirring (Japanese Patent Disclosure (Kokai) Nos. 60-146238, 146239, 146240, 146241 and 146242) and similar methods in which the pigment is redispersed, and the method of capture dispersion of secondary pigment particles (Japanese Patent Disclosure (Kokai) Nos. 60-29752 and 29753). However, the methods of pigment redispersion have problems regarding treatment capability, and the method of capture dispersion of secondary pigment particles complicates control of the concentration of the coating liquid, because of gradual decrease in the P/B (pigment/binder resin) ratio.

In addition, preparation of the dispersion in the coating liquid is usually performed by means of ball milling or sand milling. However, it is impossible to avoid admixture of impurities originating from the grinder into the dispersion. As methods of removing these impurities, the magnetic filtering method (Japanese Patent Disclosure (Kokai) No. 60-208759) and the ultracentrifuge separation method, etc., have been disclosed. However, these require fairly complicated operations.

SUMMARY OF THE INVENTION

It is an object of the present invention to provide a circulatory coating method and apparatus which makes possible the formation of a pigment containing coated film that is uniform, with no admixture of impurities or coagulation of the pigment, and a pigment containing film obtained by using this circulatory coating device.

According to the present invention, there is provided a method for forming a pigment containing film on a work-piece comprising the steps of circulating coating liquid containing pigment through a circulation path, pulverizing the pigment to disperse the pigment in the coating liquid during the circulating step and to cause the coating liquid to circulate through the circulation path, dipping a work-piece in the coating liquid during the pulverizing and circulating step, and raising the work-piece from the coating liquid.

Further, according to the present invention, there is provided an apparatus for forming a pigment containing film on a work-piece comprising a coating tank, having an inflow portion and an overflow portion, for holding coating liquid containing pigment; a circulation path having one end connected to the inflow portion of the coating tank and the other end connected to the overflow portion of the coating tank, for circulating the coating liquid; means for pulverizing the pigment to disperse the pigment in the coating liquid and to cause the coating liquid to flow in the ciruculation path; and means for dipping a work-piece in the coating liquid holded in the coating tank and raising the work-piece from the coating liquid to form a pigment containing film on the work-piece during the circulation of the coating liquid through the circulation path.

Furthermore, according to the present invention, there is provided a coated medium comprising a work-piece, and a film created on the work-piece by dipping the work-piece in circulated coating liquid circulated through a circulation path in which pigment has been dispersed in the coating liquid using an impact pulverizing disperser.

DETAILED DESCRIPTION OF THE PREFERRED EMBODIMENTS

Figure 1:
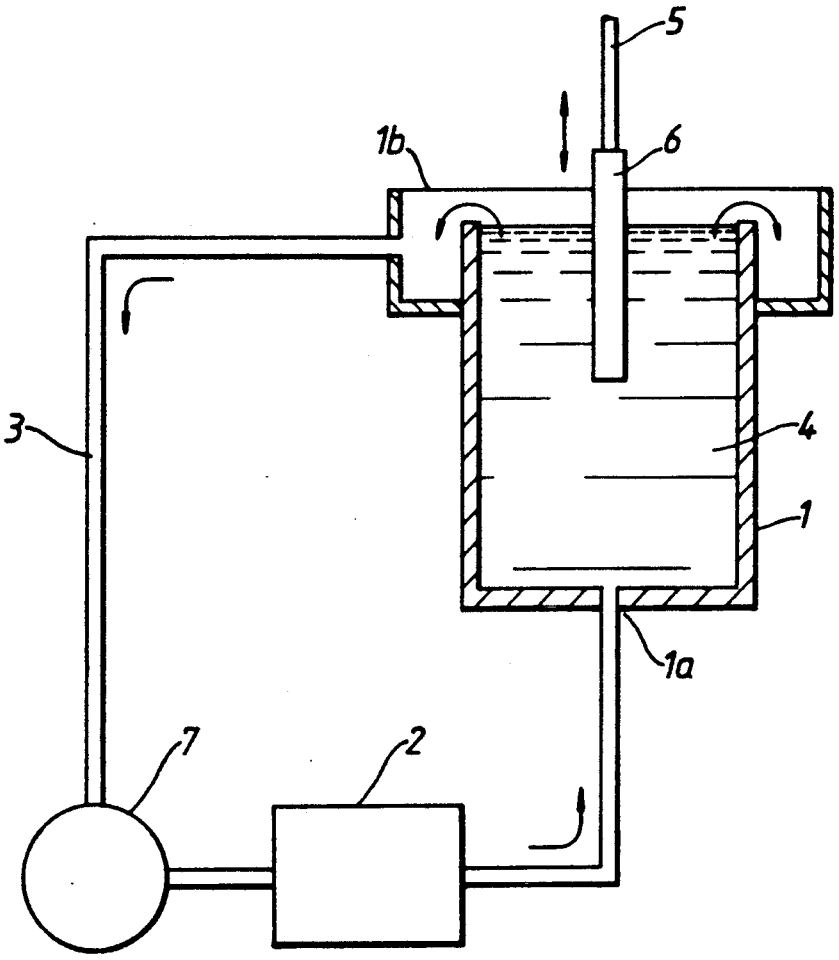
FIG. 1 is a layout diagram of a circulatory coating apparatus according to an embodiment of the present invention.

A pigment disperser of the impact pulverizing type is used in the present invention. It is an apparatus equipped with: a feeder; a high pressure pump; a branch flow zone; two flow paths connected to this branch flow zone; and a flow merging zone connected to these two flow paths. In this system dispersion of pigment etc. is performed without using grinding members such as beads or balls. The coating liquid that is introduced into the feeder is fed under high pressure by a high pressure pump into the branch flow zone, where it is divided into two flows. In the flow merging zone, the two flow paths are abruptly narrowed and brought to face each other, so that pressure is converted into flow speed. The result is that the particles of pigment are caused to collide with each other at ultra-high speed. A large quantity of coating liquid is effectively dispersed by the mutual interaction between this collision force and the cavitation due to the vacuum generated by the fluid passing at high speed. The pressure applied to the coating liquid in the flow merging zone depends on the type of pigment, but will normally be selected in the range 400 to 1300 kg/cm$^2$.

In the circulation path in the coating apparatus of the present invention there may be provided a circulation tank equipped with a stirrer, a coating liquid top-up tank, dilution liquid (solvent) top-up tank, filter, overhead tank, and liquid flow pulsation prevention devices, etc., in order to automate the coating apparatus, improve the precision which it can attain, and increase the quality of the coated film.

Although the disperser of the impact pulverizing type used in the present invention is equipped with a high pressure pump, and so itself is capable of moving the coating liquid, the circulatory path may be equipped with a further coating liquid transfer device. All types of pump may be employed for this coating liquid transfer device, such as gear pumps, eddy pumps and diaphragm pumps. However, in order to achieve uniform coating, it is desirable to use a pump that does not produce pulsations in the liquid flow. As to the positional relationship between the impact pulverizing type disperser and coating liquid transfer device, either of these may be placed upstream of the other.

The binder resin used in the present invention may be, for example, a phenoxy resin, a polycarbonate, butylyl, saturated polyester, or silicone etc. One or two or more of these may be used. These binder resins may be dissolved in a solvent consisting of one or more of dichloromethane, chloroform, 1, 2-dichloroethane, 1, 1, 2-trichloroethane, nitropropane, toluene, xylene, cyclohexanone, or dioxane. The concentration of binder resin in the solvent will normally be 0.05 to 20 weight %, preferable 0.1 to 10%, and even more preferable 0.5 to 5 weight %.

The coating liquid is formed by introducing the pigment into the binder resin solution. Examples of pigments that may be used include: copper phthalocyanin, aluminium chlorophthalocyanin, chloroindium phthalocyanin, titanyl phthalocyanin, or non-metallic phthalocyanin or like phthalocyanin pigments, polycyclic quinone pigments, perylene pigments, azo pigments, aquarium salts, and azulenium salts etc.

When the coating liquid as described above is applied by an apparatus in accordance with the present invention, the coating rate will normally be 0.1 to 100 cm/min, preferably 1 to 50 cm/min, and even more preferable 5 to 30 cm/min.

As the circulatory coating apparatus of the present invention is equipped with an impact pulverizing type disperser, the pigment is dispersed in the circulating coating liquid by means of this disperser. In the impact pulverizing type disperser, as described above, the mutual interaction of the impact force due to collision of the pigment particles and cavitation is utilized for dispersion, so a coating film can be formed without coagulation of the pigment and without admixture of impurities.

Embodiments in which photoconductive layers are formed using the apparatus of the present invention, and comparative examples using a prior art apparatus, are described below.

EMBODIMENT 1

As shown in FIG. 1, a photoconductive layer is formed on a work-piece 6 using a circulatory coating apparatus. The circulatory coating apparatus comprises a coating tank 1, Nanomizer 2, which is an impact pulverizing type disperser (manufactured by Atsuryu Industries Ltd., trade name) and a piping circulaltion path 3 for coating liquid circulation. One end of piping circulation path 3 is connected to an inflow portion 1*a* formed at the bottom of coating tank 1 and the other end of path 3 is connected to an overflow portion 1*b* formed at the upper margin portion of coating tank 1. A coating liquid 4 comprises phthalocyanin (P/B=1.0), whose vehicle is a 2% solution of phenoxy resin in 1, 1, 2-trichloro-ethane. The coating liquid 4 is introduced into coating tank 1. Work-piece 6 is mounted on a mounting device 5 equipped with raising and lowering means. Coating liquid 4 overflows from coating tank 1 with a circulatory flow amount of 1.00 l/min. Work-piece 6 is coated at a coating rate of 16.0 cm/min by dipping in coating liquid 4, and then dried to obtain a photoconductive layer on work-piece 6. In FIG. 1, circulation path 3 is provided with a gear pump 7, but, since the impact pulverizing type disperser 2 itself acts to transfer the coating liquid, this gear pump 7 may be omitted.

Coating work-piece 6 was performed both in the initial period of circulation of coating liquid 4 and after coating liquid 4 had been circulating for 20 hours. Both the photoconductive layer obtained on work-piece 6, i.e., after circulating for 20 hours and in the initial period of circulation, has the same luster. Also, when the mean particle size of the pigment in the coating liquid was measured using a centrifugal sedimentation type particle size distribution measuring device, this was found to be 0.21 during the initial period of circulation and 0.22 after 200 hours of circulation. Furthermore, when the surface roughness of the photoconductive layer after drying was determined using a surface roughness meter, this was found to be Rmax=0.06 μm after the initial period of circulation, and Rmax=0.07 μm after 200 hours circulation.

Also, when a small sample was taken from the photoconductive coated film formed using the coating liquid after 200 hours circulation, and its SEM (Scanning Electron Microscope) image was observed, it was found to be very similar to that of the photoconductive coating film obtained during the initial period of circulation, the pigment still being uniformly dispersed in the vehicle.

COMPARATIVE EXAMPLE 1

When photoconductive layers were formed in the same way as in EMBODIMENT 1 except that a gear pump, eddy pump, or diaphragm pump was used instead of the impact pulverizing type disperser used in EMBODIMENT 1, the mean particle diameter of the pigment in the coating liquid, and luster and surface roughness of the photoconductive layers were as shown in TABLE 1 below.

TABLE 1

| | Mean particle diameter of pigment (μm) | Luster of coating | Surface roughness of coating (μm) Rmax |
|---|---|---|---|
| Gear pump | | | |
| Initial period of circulation | 0.22 | YES | 0.06 |
| After five hours circulation | 1.75 | NO | 0.20 |
| Eddy pump | | | |
| Initial period of circulation | 0.12 | YES | 0.06 |
| After five hours circulation | 1.45 | NO | 0.17 |
| Diaphragm pump | | | |
| Initial period of circulation | 0.22 | YES | 0.06 |
| After five hours circulation | 1.21 | NO | 0.15 |

Also, when a small sample was taken from a photoconductive coating formed used the coating liquid after 5 hours circulation using the respective pumps, and its SEM image was observed, a spotted pattern consisting of the pigment and vehicle was seen, in contrast to the photoconductive coating obtained using the coating liquid during the initial circulation period. Such a spotted pattern shows that dispersibility of the coating liquid is lost by circulation, and agrees well with the data of TABLE 1.

COMPARATIVE EXAMPLE 2

When the coating liquid was circulated for 200 hours (circulation flow amount: 1.00 l) using a continuous sand mill instead of the disperser of the impact pulverizing type used in EMBODIMENT 1, and then left to stand, sedimentation of the grinding agent and wear products of the alumina balls in the coating liquid was observed. This phenomenon was not observed at all in the case of the coating liquid in EMBODIMENT 1.

REFERENCE EXAMPLE

Phthalocyanin was dispersed in a vehicle using an impact pulverizing type disperser (vehicle: 1.6 weight % trichloroethane solution of phenoxy resin, P/B=1.0). When the amount of contaminants was compared with the amount obtained using other batch type dispersers such as ball milling or sand milling, the results indicated in TABLE 2 below were obtained. The dispersion was performed under conditions such that practically the same dispersibility was obtained. The analysis was carried out using the atomic absorption method after acidic decomposition, the ICP (Induction Coupling Prasma) light emission analysis method, and the ICP light emission spectroscopy method after alkali decomposition. The values for the phthalocyanin powder, converted to values for the dispersion, were as follows.

TABLE 2

| | Na (ppm) | K (ppm) | Fe (ppm) | Al (ppm) | Hg (ppm) |
|---|---|---|---|---|---|
| Impact pulverizing type | 0.10 | 0.05 | 6.4 | 4.5 | 0.3 |
| Alumina ball mill | 0.08 | 0.10 | 18 | 53 | 0.51 |
| SUS ball mill | 0.05 | 0.12 | 61 | 3.9 | 0.22 |
| Glass sand mill | 2.9 | 0.73 | 36 | 12.7 | 3.2 |
| Alumina sand mill | 0.7 | 1.2 | 23 | 100 | 18 |
| Phthalocyanin powder | 0.057 | 0.066 | 10.6 | 3.83 | 0.15 |

EMBODIMENT 2

Figure 2:
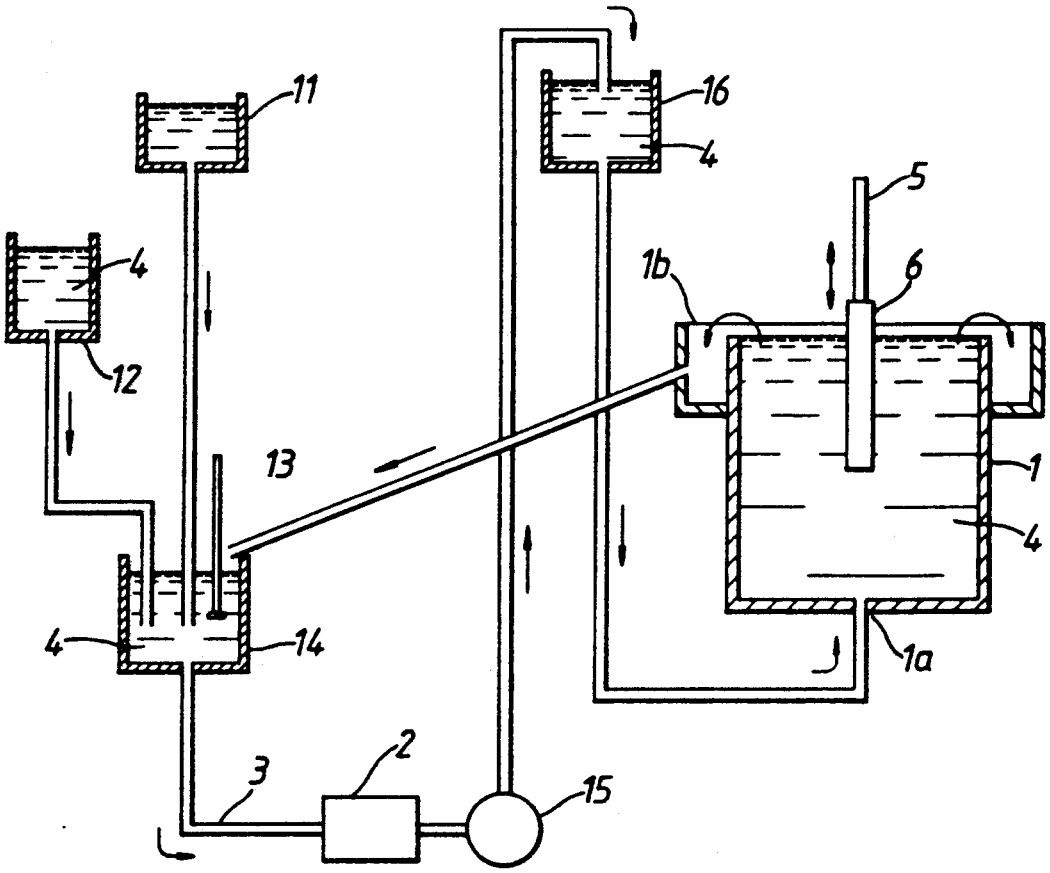
FIG. 2 is a layout diagram of a circulatory coating apparatus according to another embodiment of the present invention.

In order to improve the coating properties and smoothness of the liquid flow in continuous circulation over a long time, a circulatory coating apparatus shown in FIG. 2 was used. In the circulatory coating apparatus of FIG. 2, a dilution liquid (solvent) top-up tank 11, a coating liquid top-up tank 12, a stirrer 13, a circulation tank 14, a filter 15 and an overhead tank 16 were added to circulation path 3 of the circulatory coating apparatus used in EMBODIMENT 1. The dilution liquid is supplied from dilution top-up tank 11 to circulation tank 14, in which coating liquid 4 is contained, to decrease the concentration of coating liquid 4 if the concentration has become high during circulation in circulation path 3. If the amount of coating liquid 4 in coating tank 1 decrease due to coating onto work-piece 6, new coating liquid 4 is supplied from coating liquid top-up tank 12 to the circulation tank 14. The new coating liquid 4 is then supplied to coating tank 1 via circulation path 3. In circulation tank 14, stirrer 13 stirs coating liquid 4 to optimize the concentration of the coating liquid 4 mixed with the dilution liquid, which is supplied from dilution liquid top-up tank 11. Overhead tank 16 is arranged at a position higher than that of coating tank 1. Coating liquid 4 transferred by Nanomizer 2 is poured into overhead tank 16 to be stored. Then, the coating liquid 4 stored in overhead tank 16 is transferred into coating tank 1. By this action, the pulsation of coating liquid 4 in circulation path 3 is prevented. It is also possible to use other well known means to prevent pulsation of the liquid flow.

A photoconductive layer was formed on a work-piece 6 in the same way as in EMBODIMENT 1, but using the apparatus of EMBODIMENT 2. The photoconductive layer formed on work-piece 6 using coating liquid 4 which had circulated for 1,000 hours maintained the same luster as a coating formed by the coating liquid in the initial period of circulation, just as in the case of EMBODIMENT 1. The mean particle diameters of the pigment in the coating liquid were respectively 0.21 (initial circulation period), and 0.22 (after circulation for 1,000 hours). Furthermore, the surface roughness of the photoconductive layer after drying was Rmax=0.06 μm (initial period of circulation), and Rmax=0.07 μm (after 200 hours circulation).

The uniformity of the film thickness of the photoconductive layer was also further improved from that of EMBODIMENT 1.

With the circulatory coating apparatus according to the present invention, as described above, a stable pigment coating dispersion is obtained without coagulation of the pigment and without admixture of impurites even though a pigment-rich low visconsity dispersion is circulated for long period of time. As a result, pigment containing coated films of improved functionality can easily be obtained under precise film thickness control.

What is claimed is:

1. A method of forming a pigment containing film on a workpiece, comprising the steps of:

(a) circulating a coating liquid which includes pigment particles through a circulation path;

(b) dividing the circulating coating liquid into two distinct flow streams;

(c) colliding the two flow streams so that the pigment particles impact each other;

(d) dipping the workpiece in the coating liquid during steps (a), (b) and (c); and (e) raising the workpiece from the coating liquid.

2. A method according to claim 1, further comprising a step of applying pressure to said coating liquid during steps (b) and (c).

3. A method according to claim 2, wherein a pressure of 400 to 1300 $kg/cm^2$ is applied to said coating liquid.

4. A method according to claim 1, further comprising, between steps (b) and (c), a step of narrowing said flow streams.

5. A method according to claim 1, wherein said workpiece is coated at a rate of 0.1 to 100 cm/min.

6. A method according to claim 5, wherein said workpiece is coated at a rate of 1 to 50 cm/min.

7. A method according to claim 6, wherein said workpiece is coated at a rate of 5 to 30 cm/min.

8. A method according to claim 1, further comprising introducing a dilution liquid to said coating liquid during step (a).

9. A method according to claim 1, further comprising, subsequent to step (c), temporarily storing said coating liquid in a tank so as to prevent pulsation of said coating liquid in said circulation path.

* * * * *